US008836614B1

(12) United States Patent
Wang

(10) Patent No.: US 8,836,614 B1
(45) Date of Patent: Sep. 16, 2014

(54) DISPLAY PANEL CONTROL CIRCUIT AND MULTI-CHIP MODULE THEREOF

(71) Applicant: Der-Jiunn Wang, HsinChu (TW)

(72) Inventor: Der-Jiunn Wang, HsinChu (TW)

(73) Assignee: Richtek Technology Corporation, Zhubei, Hsinchu (TW)

( * ) Notice: Subject to any disclaimer, the term of this patent is extended or adjusted under 35 U.S.C. 154(b) by 85 days.

(21) Appl. No.: 13/778,543

(22) Filed: Feb. 27, 2013

(51) Int. Cl.
*G09G 3/28* (2013.01)
*H05B 37/02* (2006.01)

(52) U.S. Cl.
CPC ..... *H05B 37/02* (2013.01)
USPC ..... 345/69; 345/104

(58) Field of Classification Search
USPC ..... 315/169.1, 169.3; 345/104, 105, 79, 69
See application file for complete search history.

(56) References Cited

U.S. PATENT DOCUMENTS 7,271,802 B2 * 9/2007 Wang et al. ..... 345/211
7,327,334 B2 * 2/2008 Chen et al. ..... 345/66
8,203,508 B2 * 6/2012 Yang ..... 345/69

* cited by examiner

*Primary Examiner* — Minh D A
(74) *Attorney, Agent, or Firm* — Tung & Associates

(57) ABSTRACT

The present invention provides a display panel control circuit, including: a voltage adjustment unit including a high side switch coupled between an output terminal and a high voltage source, a low side switch coupled between the output terminal and a low voltage source, and a voltage adjustment switch coupled between the output terminal and a switching node; a direction control unit, including a first diode having a cathode coupled to the switching node and an anode coupled to a voltage rising node, and a second diode having an anode coupled the switching node and a cathode coupled to a voltage falling node; a voltage rising resistor coupled between the voltage rising node and a shaping voltage source; and a voltage falling resistor coupled between the voltage falling node and the shaping voltage source.

10 Claims, 4 Drawing Sheets

DISPLAY PANEL CONTROL CIRCUIT AND MULTI-CHIP MODULE THEREOF

BACKGROUND OF THE INVENTION

1. Field of Invention

The present invention relates to a display panel control circuit, in particular a display panel control circuit which separates the current sourcing path and the current sinking path by two different resistor circuits and providing two diodes respectively in the two paths.

2. Description of Related Art

A basic driving voltage waveform for driving pixels in a LCD display is as shown by the waveform 1 in FIG. 1, wherein the driving voltage switches between a high level and a low level. For a better performance in driving pixels, a "gate shaping" technique is proposed. When the driving voltage switches from low level to high level, the gate shaping technique pre-raises the driving voltage to a mid level, and when the driving voltage switches from high level to low level, the gate shaping technique pre-drops the driving voltage to a mid level, so as to reduce the gap between level switching. If the driving voltage switches its levels too fast (switches between levels with a large gap in a short time), the feed through effect caused by parasitic capacitance may affect the pixel grayscale and cause it to deviate. In FIG. 1, the vertical scale represents voltage and the horizontal scale represents time. The waveform 1 is a waveform without gate shaping, and the waveforms 2-4 are waveforms with various gate shaping types (such as the rising gate shaping A and the falling gate shaping B) which are designed according to different practical needs.

Referring to FIG. 2, a prior art display panel control circuit 10 is shown. The waveforms shown in FIG. 1 are to be generated at an output terminal VG. The voltages VGH and VGL are high voltage source and low voltage source respectively, which correspond to the high level and the low level shown in FIG. 1. Assuming that the circuit 10 is to generate the waveform 2 of FIG. 1, it operates as follows: First, the switch ML is turned on and the switches MH, MD1, and MD2 are turned off to generate the low level of the waveform 2. Next, the switches MH and ML are turned off and the switches MD1 and MD2 are turned on, so that a voltage terminal AVDD charges the output terminal VG to generate the rising gate shaping A in the waveform 2, wherein the slope of the rising gate shaping A is determined by the resistor R: the output driving voltage rises faster when the resistor R has a smaller resistance, and the output driving voltage rises slower when the resistor R has a higher resistance. Next, the switch MH is turned on and the switches M1, MD1 and MD2 are turned off, so that the high voltage source VGH supplies power to the output terminal VG to generate the high level of the waveform 2. Next, before switching the voltage at the output terminal VG to low level, the switches MH and ML are turned off and the switches MD1 and MD2 are turned on so that the output terminal VG discharges toward the voltage terminal AVDD to generate the falling gate shaping B in the waveform 2, and the slope of the falling gate shaping B is likewise determined by the resistor R. The aforementioned prior art has a drawback that the rising gate shaping A and the falling gate shaping B are both controlled by the same resistor R, so the rising and falling slopes can not be set differently.

Referring to FIG. 3, another prior art display panel control circuit 20 is shown. Compared to the display panel control circuit 10, the display panel control circuit 20 is different in that: the resistor R is replaced by a parallel circuit including a voltage rising resistor Rr which is connected is series with a voltage rising diode Dr, and a voltage falling resistor Rf. The rising slop of the rising gate shaping A is decided by the resistance of the parallel circuit; the falling slope of the falling gate shaping B is decided by the resistance of the voltage falling resistor Rf. Although in this circuit the rising and falling slopes can be set differently, the setting is complicated because it requires calculating the resistance of the parallel circuit and the rising slope and the falling slope affects each other.

Referring to FIG. 4, another prior art display panel control circuit 30 is shown. Compared to the display panel control circuit 10, the voltage falling resistor Rf and the switches MD1 and MD2 correspond to the resistor R and the switches MD1 and MD2 shown in FIG. 2, but the display panel control circuit 30 further includes another group of voltage rising resistor Rr and switches MR1 and MR2. The rising gate shaping is generated by conducting the voltage rising resistor Rr and the switches MR1 and MR2, and the falling gate shaping is generated by conducting the voltage falling resistor Rf and the switches MD1 and MD2. In short, the voltage rising resistor Rr and the voltage falling resistor Rf respectively decide the slopes of the rising gate shaping and the falling gate shaping, so they can be set differently without complicated calculation. Although this prior art has the advantage of easier setting, the additional switches MR1 and MR2, which require to be high voltage transistors, significantly increase the cost.

Hence, it is desired to provide a simple and low cost display panel control circuit wherein the slopes of the rising gate shaping and the falling gate shaping can be set differently and easily.

SUMMARY OF THE INVENTION

In one embodiment, the present invention discloses a display panel control circuit, for providing a control voltage at an output terminal to control pixels of a display panel, the display panel control circuit including: a voltage adjustment unit including a high side switch coupled between an output terminal and a high voltage source, a low side switch coupled between the output terminal and a low voltage source, and a voltage adjustment switch coupled between the output terminal and a switching node; a direction control unit, including a first diode having a cathode coupled to the switching node and an anode coupled to a voltage rising node, and a second diode having an anode coupled the switching node and a cathode coupled to a voltage falling node; a voltage rising resistor coupled between the voltage rising node and a shaping voltage source; and a voltage falling resistor coupled between the voltage falling node and the shaping voltage source.

In another embodiment, the present invention discloses a display panel control circuit, for providing a control voltage at an output terminal to control pixels of a display panel, the panel control circuit including: a voltage adjustment unit, including a high side switch coupled between the output terminal and a high voltage source, a low side switch coupled between the output terminal and a low voltage source, and a voltage adjustment switch coupled between the output terminal and a switching node; a voltage rising resistor, coupled to the switching node; a voltage falling resistor, coupled to the switching node; and a direction control unit, including a first diode having a cathode coupled to voltage rising resistor and an anode coupled to a shaping voltage source, and a second diode having an anode coupled the voltage falling resistor and a cathode coupled to the shaping voltage source.

Preferably, the voltage adjustment switch includes: two transistor switches connected in series, wherein their parasitic diodes are connected at different bias directions; or a transistor switch having a parasitic diode whose bias direction is adjustable.

In a preferable embodiment of the present invention, the voltage adjustment unit and the direction control unit can be integrated in one chip, or respectively integrated in separate chips which are packaged in one multi-chip module.

In a preferable embodiment of the present invention, the voltage rising resistor and the voltage falling resistor are external devices to the chip or chips.

In another embodiment, the present invention discloses a multi-chip module of display panel control circuit, for providing a control voltage at an output terminal to control pixels of a display panel, and the multi-chip module of display panel control circuit includes: a first chip, including a high side switch coupled between the output terminal and a high voltage source, a low side switch coupled between the output terminal and a low voltage source, and a second chip, including a first diode having a cathode coupled to the switching node and an anode for coupling to a shaping voltage source through a voltage rising resistor, and a second diode having an anode coupled the switching node and a cathode for coupling to the shaping voltage source through a voltage falling resistor.

The objectives, technical details, features, and effects of the present invention will be better understood with regard to the detailed description of the embodiments below, with reference to the drawings.

DESCRIPTION OF THE PREFERRED EMBODIMENTS

The drawings as referred to throughout the description of the present invention are for illustrative purpose only, but not drawn according to actual scale. The orientation wordings in the description such as: above, under, left, or right are for reference with respect to the drawings, but not for limiting the actual product made according to the present invention.

Figure 5:
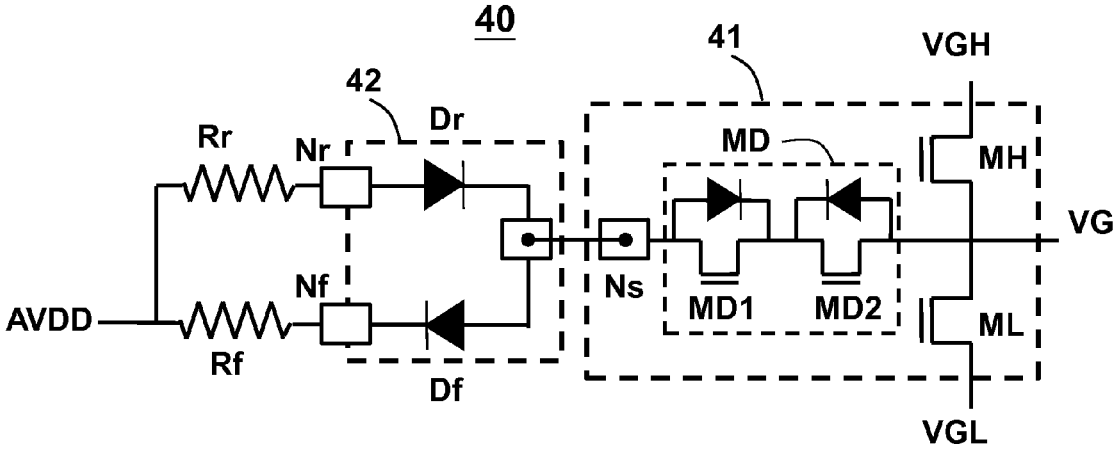
FIG. 5 shows a preferable embodiment of the display panel control circuit according to the present invention.
Figure 6:
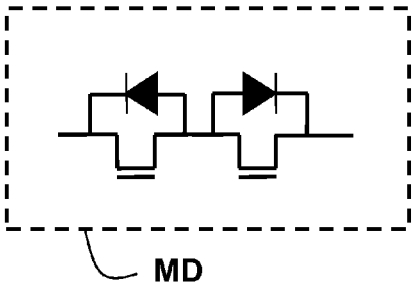
FIGS. 6 and 7 show two preferable embodiments of the voltage adjustment switches according to the present invention.
Figure 7:
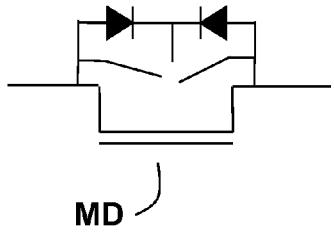

FIG. 5 shows an embodiment of the display panel control circuit 40 according to the present invention, which includes a voltage adjustment unit 41, a direction control unit 42, a voltage rising resistor Rr, and a voltage falling resistor Rf. The voltage adjustment unit 41 includes a high side switch MH coupled between the output terminal VG and a high voltage source VGH, a low side switch ML coupled between the output terminal VG and a low voltage source VGL, and a voltage adjustment switch MD coupled between the output terminal VG and a switching node Ns. In this embodiment, the voltage adjustment switch MD includes two transistor switches MD1 and MD2 connected in series, wherein their parasitic diodes are connected at different bias directions; in another embodiment, can have the structure as shown in FIG. 6. Or, the voltage adjustment switch MD can be a transistor switch having a parasitic diode whose bias direction is adjustable, such as the structure shown in FIG. 7. The direction control unit 42 includes a first diode Dr and a second diode Df; the first diode Dr is coupled between the switching node Ns and a voltage rising node Nr, and it has a cathode coupled to the switching node Ns and an anode coupled to the voltage rising node Nr. The second diode Df is coupled between the switching node Ns and a voltage falling node Df, and it has an anode coupled the switching node Ns and a cathode coupled to the voltage falling node Df. A voltage terminal (shaping voltage source) AVDD is coupled to the voltage rising node Nr and the voltage falling node Nf respectively through a voltage rising resistor Rr and a voltage falling resistor Rf, wherein the voltage rising resistor Rr and the voltage falling resistor Rf can be set to have equal or different resistances, to respectively decide the rising and falling gate shaping waveforms (the slopes of the rising gate shaping and falling gate shaping).

Assuming that the circuit 40 is to generate the waveform 2 of FIG. 1, it operates as follows:

(1) When the switch ML is turned on, and the switch MH and the voltage adjustment switch MD are turned off, the low voltage source VL is electrically connected to the output terminal VG such that the voltage at the output terminal VG is the low level.

(2) Before the voltage at the output terminal VG is switched to high level, the switches ML and MH are turned off and the voltage adjustment switch MD is turned on, such that the voltage terminal AVDD charges the output terminal VG; the current flows from the voltage terminal AVDD, through the voltage rising resistor Rr, the first diode Dr (the second diode is not in conduction), the switching node Ns, and the voltage adjustment switch MD, to the output terminal VG. A gate shaping waveform such as the gate shaping A shown in FIG. 1 is generated by the effect of the voltage rising resistor Rr.

(3) Next, the voltage adjustment switch MD and the switch ML are turned off, and the switch MH is turned on, such that the high voltage source VGH supplies power to the output terminal VG to output the high level.

(4) Before the voltage at the output terminal VG is switched to low level, the ML and MH switches are turned off and the voltage adjustment switch MD is turned on, such that the output terminal VG discharges through the voltage terminal AVDD. The current flows from the output terminal VG, through the voltage adjustment switch MD, the switching node Ns, the second diode Df (the first diode is not in conduction), and the voltage falling resistor Rf, to the voltage terminal AVDD. A gate shaping waveform such as the gate shaping B shown in FIG. 1 is generated by the effect of the voltage falling resistor Rf.

(5) Next, the voltage adjustment switch MD and the switch MH are turned off and the switch ML is turned on, such that the low voltage source VGL is electrically connected to the output terminal VG to output the low level.

Figure 1:
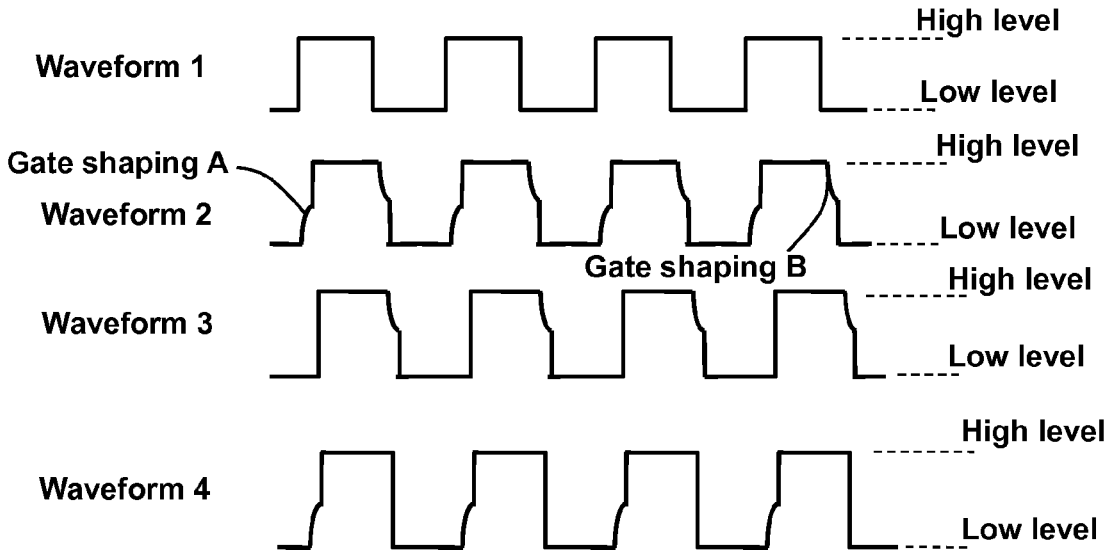
Fig. 1 (Prior art)
FIG. 1 shows a prior art display control voltage waveforms.

The above description is for generating the waveform 2 shown in FIG. 1; apparently, the display panel control circuit 40 of the present invention can generate any one of the waveforms 1-4.

Figure 2:
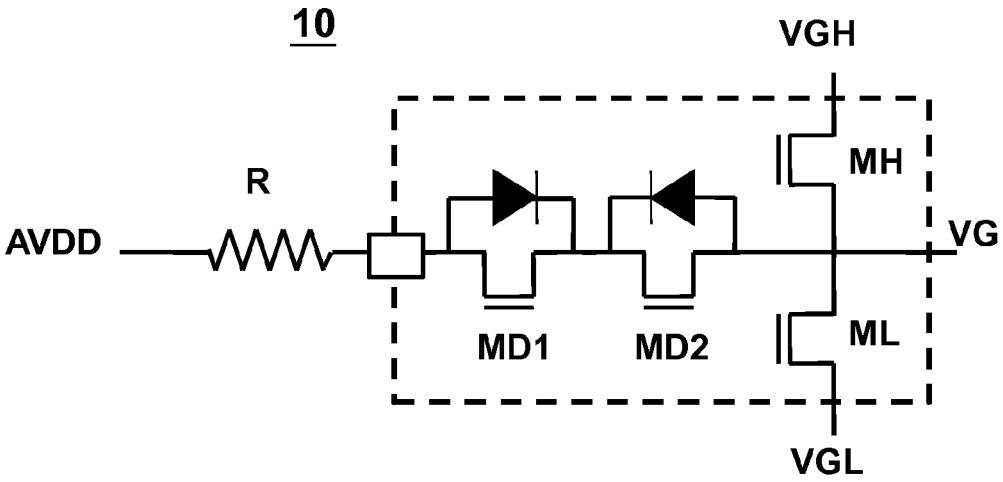
Fig. 2 (Prior art)
FIG. 2 shows another prior art display panel control circuit.
Figure 3:
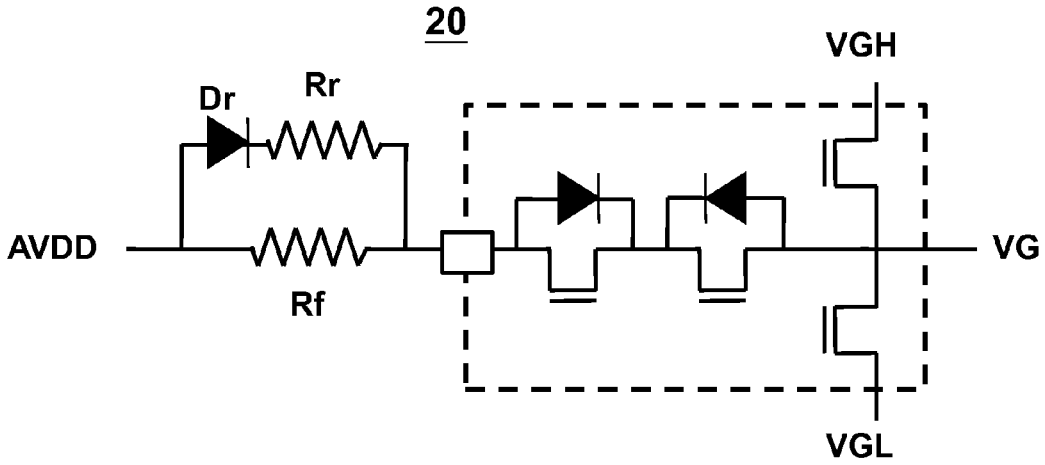
Fig. 3 (Prior art)
FIG. 3 shows another prior art display panel control circuit.
Figure 4:
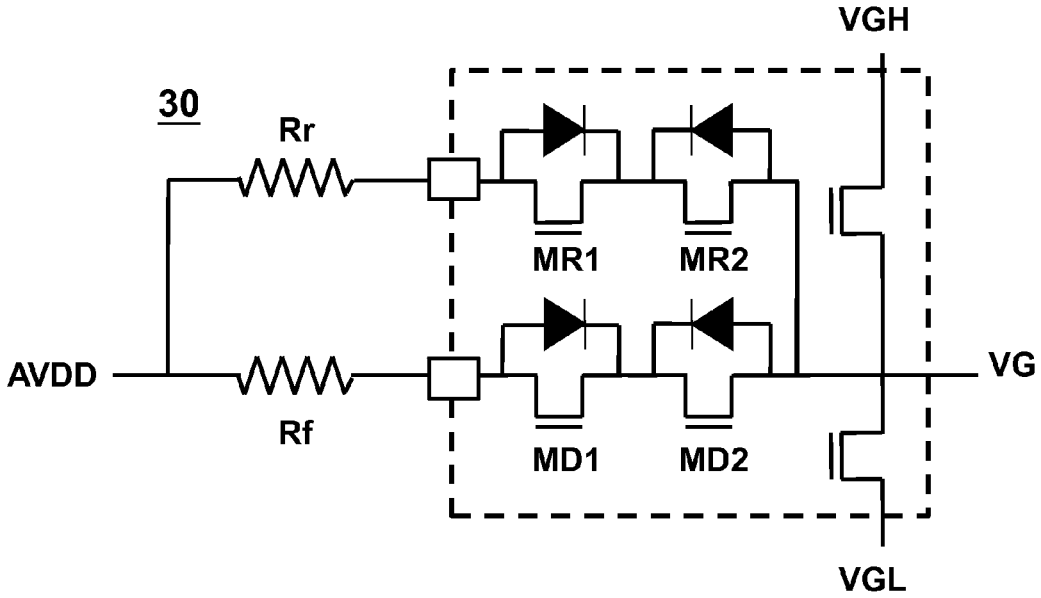
Fig. 4 (Prior art)
FIG. 4 shows yet another prior art display panel control circuit.

Referring to FIGS. 2 and 5, when the voltage at the output terminal VG is to be rising from low level, the switches ML and MH are turned off and the voltage adjustment switch MD is turned on, so that the current flows from the voltage terminal AVDD, through the voltage rising resistor Rr, the first diode Dr, and the switching node Ns, to the voltage adjustment switch MD to charge the output terminal VG. Between the voltage terminal AVDD and the output terminal VG, the primary voltage drop is the voltage difference VD between two sides of the first diode Dr, so the voltage drop between the voltage terminal AVDD and the output terminal VG can be expressed as AVDD-VGL-VD; the primary resistance results from the voltage rising resistor Rr, so the slope of the rising gate shaping can be decided by the equation: (AVDD-VGL-VD)/Rr. However, if the internal resistance of the first diode Dr or the voltage drop caused by the switches MD1 and MD2 are significant, then these parameters should be included in the equation.

When the voltage at the output terminal VG is to be falling from high level, the switches ML and MH are turned off and the voltage adjustment switch MD is turned on; the current flows from the output terminal VG, through the voltage adjustment switch MD, the switching node Ns, the second diode Df, and the voltage falling resistor Rf, to the voltage terminal AVDD. Between the voltage terminal AVDD and the output terminal VG, the primary voltage drop is the voltage difference VD between two sides of the second diode Df, so the voltage drop between the voltage terminal AVDD and the output terminal VG can be expressed as VGH-AVDD-VD; the primary resistance results from the voltage falling resistor Rf, so the slope of the falling gate shaping can be decided by the equation: (VGH-AVDD-VD)/Rf. However, if the internal resistance of the second diode Df or the voltage drop caused by the switches MD1 and MD2 are significant, then these parameters should be included in the equation.

The voltage at the output terminal VG for example can be a control voltage for controlling a gate of a transistor in the display panel, wherein the transistor controls a pixel by controlling the rotation angle of the liquid crystal in the pixel, to display a corresponding grayscale pixel image.

In the circuit shown in FIG. 5, the voltage adjustment unit 41 and the direction control unit 42 can be integrated in one chip, or they can be respectively integrated in separate chips and packaged in one multi-chip module. The voltage rising resistor Rr and the voltage falling resistor Rf can be external devices to the integrated chip or the chips, so that a user can set different slopes of the gate shaping waveforms by setting different resistances.

Figure 8:
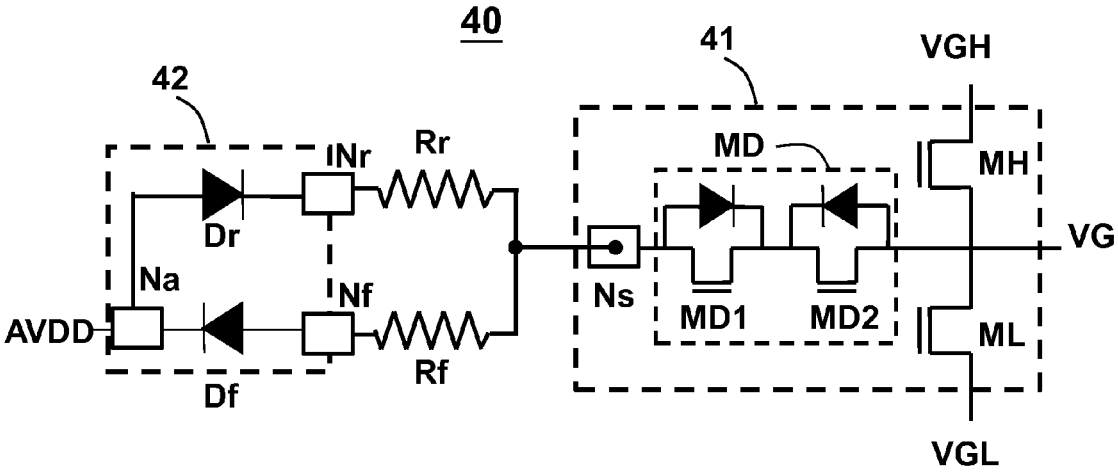
FIG. 8 shows another preferable embodiment of the display panel control circuit according to the present invention.

In another embodiment of the present invention, the display panel control circuit can be as shown in FIG. 8, which is also within the scope of the present invention. However, because the voltage rising resistor Rr and the voltage falling resistor Rf are preferred to be external devices for user setting, the circuit of FIG. 8 requires additional pins Ns and Na which are not required to be pins in the circuit of FIG. 5, and the related cost is therefore higher. If the voltage rising resistor Rr and the voltage falling resistor Rf are not external devices, then the circuit shown in FIG. 8 has the same effect as FIG. 5.

In comparison with the prior art circuits, the display panel control circuit or the multi-chip module of display panel control circuit according to the present invention has the benefits of lower cost and easy gate shaping setting, better than the prior art circuits.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a circuit or device such as switch which does not affect the primary function can be inserted between two devices/circuits shown to be in direct connection in the figures. An embodiment or a claim of the present invention does not need to attain or include all the objectives, advantages or features described in the above. The abstract and the title are provided for assisting searches and not to be read as limitations to the scope of the present invention.

What is claimed is:

1. A display panel control circuit, providing a control voltage at an output terminal to control pixels of a display panel, the panel control circuit comprising:

a voltage adjustment unit, including a high side switch coupled between the output terminal and a high voltage source, a low side switch coupled between the output terminal and a low voltage source, and a voltage adjustment switch coupled between the output terminal and a switching node;

a direction control unit, including a first diode having a cathode coupled to the switching node and an anode coupled to a voltage rising node, and a second diode having an anode coupled the switching node and a cathode coupled to a voltage falling node;

a voltage rising resistor, coupled between the voltage rising node and a shaping voltage source; and a voltage falling resistor, coupled between the voltage falling node and the shaping voltage source.

2. The display panel control circuit of claim 1, wherein the voltage adjustment switch includes: two transistor switches connected in series, wherein their parasitic diodes are connected at different bias directions; or a transistor switch having a parasitic diode whose bias direction is adjustable.

3. The display panel control circuit of claim 1, wherein the voltage adjustment unit and the direction control unit are integrated in one chip, or respectively integrated in separate chips which are packaged in a multi-chip module.

4. The display panel control circuit of claim 3, wherein the voltage rising resistor and the voltage falling resistor are external devices to the chip or chips.

5. A display panel control circuit, providing a control voltage at an output terminal to control pixels of a display panel, the panel control circuit comprising:

a voltage adjustment unit, including a high side switch coupled between the output terminal and a high voltage source, a low side switch coupled between the output terminal and a low voltage source, and a voltage adjustment switch coupled between the output terminal and a switching node;

a voltage rising resistor, coupled to the switching node;

a voltage falling resistor, coupled to the switching node; and a direction control unit, including a first diode having a cathode coupled to voltage rising resistor and an anode coupled to a shaping voltage source, and a second diode having an anode coupled the voltage falling resistor and a cathode coupled to the shaping voltage source.

6. The display panel control circuit of claim 5, wherein the voltage adjustment switch includes: two transistor switches connected in series, wherein their parasitic diodes are connected at different bias directions; or a transistor switch having a parasitic diode whose bias direction is adjustable.

7. The display panel control circuit of claim 5, wherein the voltage adjustment unit and the direction control unit are integrated in one chip, or respectively integrated in separate chips which are packaged in a multi-chip module.

8. The display panel control circuit of claim 7, wherein the voltage rising resistor and the voltage falling resistor are external devices to the chip or chips.

9. A multi-chip module of display panel control circuit, providing a control voltage at an output terminal to control pixels of a display panel, the multi-chip module of display panel control circuit comprising:

a first chip, including a high side switch coupled between the output terminal and a high voltage source, a low side switch coupled between the output terminal and a low voltage source, and a voltage adjustment switch coupled between the output terminal and a switching node; and a second chip, including a first diode having a cathode coupled to the switching node and an anode for coupling to a shaping voltage source through a voltage rising resistor, and a second diode having an anode coupled the switching node and a cathode for coupling to the shaping voltage source through a voltage falling resistor.

10. The multi-chip module of display panel control circuit of claim 9, wherein the voltage adjustment switch includes: two transistor switches connected in series, wherein their parasitic diodes are connected at different bias directions; or a transistor switch having a parasitic diode whose bias direction is adjustable.

* * * * *